United States Patent [19]

Almand, III et al.

[11] 4,163,869

[45] Aug. 7, 1979

[54] ELECTRICAL CONNECTION BETWEEN ALUMINUM CONDUCTORS

[75] Inventors: John Z. Almand, III, Marietta; Henry F. Benner, Athens, both of Ga.; William J. Reichenecker, Penn Hills Borough, Pa.

[73] Assignee: Westinghouse Electric Corp., Pittsburgh, Pa.

[21] Appl. No.: 847,865

[22] Filed: Nov. 2, 1977

[51] Int. Cl.[2] ..... H01R 5/04

[52] U.S. Cl. ..... 174/94 R; 219/127; 219/137 R; 228/165; 403/272

[58] Field of Search ..... 219/127, 137 R, 118, 219/91; 403/271, 272; 228/165, 139; 174/94 R; 339/275 R; 336/192

[56] References Cited

U.S. PATENT DOCUMENTS

| | | | |
|---|---|---|---|
| 2,371,823 | 3/1945 | Jackson | 219/137 R |
| 3,001,057 | 9/1961 | Hackman et al. | 219/127 |
| 3,102,948 | 9/1963 | McCampbell et al. | 219/127 X |
| 3,138,658 | 6/1964 | Weimer, Jr. | 174/94 R |
| 3,531,619 | 9/1971 | Broodman | 219/137 R |
| 3,640,556 | 2/1972 | Bennett | 219/91 X |
| 3,688,080 | 8/1972 | Cartwright et al. | 219/137 R |
| 3,740,685 | 6/1973 | Fisher | 336/192 |

OTHER PUBLICATIONS

Metals Handbook, "Welding and Brazing," vol. 6, copyright Aug. 1971, ASM Handbook Committee, pp. 318 and 319.

*Primary Examiner*—Thomas J. Kozma
*Attorney, Agent, or Firm*—D. R. Lackey

[57] ABSTRACT

An electrical conductor connection between at least two aluminum conductors which includes a weld nugget having a substantially cylindrical cross-sectional configuration perpendicular to the major surfaces of the aluminum conductors. The ends of the weld nugget are convexly cupped and extend outwardly past the major surfaces of the aluminum conductors to provide visual verification of joint integrity. The electrical conductor connection is formed by a method which includes providing an aperture in one of the conductors to be joined and providing a recessed backup against the other conductor, aligned with the aperture. Timed, multiple sequence MIG arc spot welding provides a weld nugget having the desired shape and diameter at the interface or throat between the two conductors. The method also enables the welding operation to be performed out of position, without sag or run of the molten pool of aluminum.

2 Claims, 6 Drawing Figures

ELECTRICAL CONNECTION BETWEEN ALUMINUM CONDUCTORS

BACKGROUND OF THE INVENTION

1. Field of the Invention

The invention relates in general to the joining of aluminum conductors, and more specifically to MIG arc spot welding of aluminum conductors to form electrical conductor connections.

2. Description of the Prior Art

Aluminum has successfully replaced copper in a large number of electrical conductor applications. Whether or not aluminum may be successfully used in a specific conductor application is usually dependent upon the availability of an economical and reliable process for making joints between conductor members.

Copper can be readily soldered with rosin-type fluxes with no corrosion problems due to flux residues, and copper can be fluxless brazed in air using certain brazing alloys. Aluminum soldering generally requires the use of fluxes which leave corrosive residues, and these residues thus must be completely removed to avoid corrosion problems. Aluminum can be successfully brazed in a vacuum, but vacuum-brazing is limited to those applications susceptible to the placement of the entire assembly in a vacuum chamber.

Aluminum conductors can be welded, with a common aluminum welding process being gas-shielded metal arc spot welding using consummable electrodes, hereinafter referred to as MIG arc spot welding.

Certain of the coils in distribution-type transformers are formed of aluminum strip. Copper, however, has been used to form the conductor members which make the internal connections to the aluminum strip, as well as for making the flexible leads which proceed from the internal connections to the bushing studs. Substantial cost savings are possible by replacing these copper connections and leads with aluminum members, but an appropriate joining technique for making aluminum-to-aluminum joints must be developed before the savings can be realized. The joining technique must be applicable to production line techniques, it must be reliable and reproducible with minimum operator skill level, it must be low cost, and it must produce joints which may be visually inspected for joint integrity.

SUMMARY OF THE INVENTION

Briefly, the present invention is a new and improved electrical conductor connection between at least two aluminum conductor members, which utilizes the MIG arc welding process. A new and improved process for making the electrical conductor connection is also disclosed. The process produces full penetration welds, in which the total quantity of weld metal is deposited in two or more timed sequence welds. The conductors to be joined are lapped and tightly clamped, with the conductor facing the welding electrode, hereinafter referred to as the first conductor, having a pilot hole therein. A recessed backup is placed adjacent to the other conductor, hereinafter referred to as the second conductor. The recess, which is vented, is aligned with the pilot hole. The area to be welded is shielded with an inert gas, and a first arc is struck from a consummable aluminum electrode which is centered in the pilot hole, to the surface of the second conductor accessible through the pilot hole. The first arc is timed and terminated, with the time being selected to enable a portion of a second conductor to melt and enter the recess. A predetermined quantity of the consummable electrode is also melted and added to the weld pool. A timed delay, during which the shielding gas is maintained, is followed by at least one additional timed welding arc, which adds additional metal to the weld pool to fill the pilot hole and provide a convexly cupped end which extends outwardly past the outer surface of the first conductor.

This new and improved multiple timed MIG arc welding process provides a full penetration weld, with the dimension of the weld nugget at the interface or throat between the two conductors being at least 0.375 inch (9.5 mm), using conductors which have a thickness of 0.100 to 0.125 inch (2.54 to 3.2 mm), or greater, to assure a high strength joint. The weld nugget has a highly desirable substantially cylindrical cross-sectional configuration, instead of the usual cone or funnel shape. The recess forms a convexly cupped root end on the weld nugget, which, along with the convexly cupped upper end, provide easy visual inspection of the weld on the production line.

This new and improved multiple timed MIG arc welding process also permits out-of-position welds to be made without sag or run of the molten weld pool. The practicability of out-of-position welds may reduce the complexity and cost of the automation equipment in the production line.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
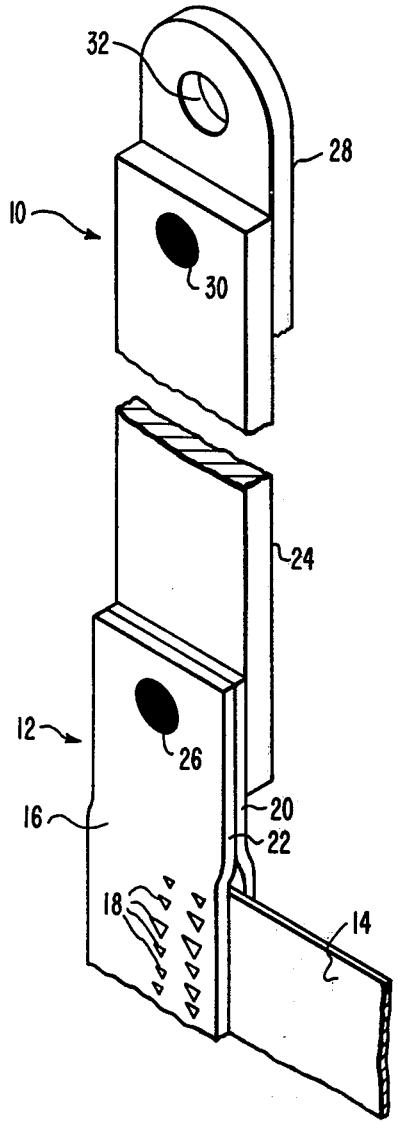
FIG. 1 is a fragmentary, perspective view of aluminum electrical conductor connections made according to the teachings of the invention.

Referring now to the drawings, and to FIG. 1 in particular, there is shown a fragmentary, perspective view of electrical conductor connections 10 and 12 made according to the teachings of the invention. Electrical conductor connections are illustrated relative to a strip or sheet conductor 14, which is part of a transformer coil or winding. A transformer application is illustrated because the present invention solved certain problems relative to joining aluminum parts to aluminum transformer windings. The invention, however, is broadly applicable to electrical conductor connections between at least two aluminum conductor members.

In the transformer application illustrated in FIG. 1, the sheet or strip conductor 14 is formed of soft aluminum, and an aluminum bi-fold or crimped terminal 16 is secured to the sheet conductor 14. Crimp terminal 16 is formed of hard aluminum plate, such as a plate formed of EC aluminum-1100H14 having a thickness of 0.0625 to 0.070 inch (1.59 to 1.78 mm), for example. The plate has a plurality of tangs 18 formed therein. The plate is bent flat about the sheet or strip 14, with the tangs biting into the sheet 14 to provide a good joint, both electrically and mechanically. The tangs 18 bite through any oxide and/or other insulating film on the surface of the sheet 14, making it unnecessary to clean the sheet 14 prior to the joining step. Two superposed layers 20 and 22 of crimp terminal 16 which extend above the sheet conductor 14, form a first aluminum conductor which has a composite thickness of 0.125 inch to 0.140 inch (3.2 to 3.6 mm), for example, which is joined to a second aluminum conductor 24 via a fusion of aluminum or weld nugget 26, which forms the second electrical conductor connection 12. Electrical conductor 24 must be a flexible lead to facilitate assembly, and as such it is formed of dead soft aluminum strap such as EC aluminum-1100-0. Conductor 24 has a thickness of 0.102 to 0.156 inch (2.6 to 4.0 mm), for example. Since the connections at the bushing studs are bolted connections, and the soft aluminum lead 24 may creep under the pressure of a bolted connection, a third aluminum conductor or tab 28, formed of hard aluminum such as EC 1100H14, is joined to the soft aluminum conductor 24 via a fusion of aluminum or weld nugget 30, which forms the first electrical conductor connection 10. Tab 28, which may have a thickness of about 0.125 inch (3.2 mm), for example, has an aperture 32 therein for receiving a bushing stud.

In the prior art, the crimp terminal 16 is made of copper, and a flexible copper strap lead is fluxless resistance brazed to the crimp terminal using a Cu-Ag-P brazing alloy. The free end of the copper strap lead is directly bolted to a bushing stud. Thus, since the aluminum parts require an additional electrical conductor connection, the aluminum to aluminum joining method must be low cost and reliable, in order to prevent the joining method from off-setting the material cost savings.

A typical distribution type transformer has two low voltage windings formed of sheet aluminum, requiring four bi-fold crimp terminals, and thus when aluminum is used, as taught by the invention, a total of eight electrical conductor connections are required, in addition to the crimp terminal connections. The tab 28 may be joined to the lead 24 in a separate operation remote from the transformer assembly line, and the electrical conductor connection 10 may be formed with the conductors 24 and 28 oriented to use down-hand welding. The crimp terminal 16 extends vertically upward from the transformer winding assembly. Thus, the winding assembly must be manipulated to orient the crimp terminals in the required position for down-hand welding, or the joining operation may be performed with the flat major opposed surface of the crimp terminal 16 and the lead 24 oriented in a vertical plane. It would be desirable to provide a joining process which is capable of providing electrical conductor connection 12 with the conductors 16 and 24 oriented vertically, as viewed in FIG. 1.

Some additional requirements for the process of joining the aluminum conductors are as follows:

(a) the joining of the aluminum conductors must be accomplished without the use of flux,
(b) the joining process must be highly reproducible,
(c) the joints must be highly reliable, with sufficient mechanical strength to withstand assembly stresses, and with sufficient electrical conductivity to carry the transformer current over the useful operating life of the transformer without abnormal heating or deterioration,
(d) the joints must be capable of being made at a very low cost,
(e) the integrity of the joints must be visually inspectable on the production line,
(f) four joints to four crimp terminals must be formed in one minute, or less, under shop conditions, with minimal operator skill level, and
(g) the joints must be made without any cleaning of the aluminum conductors at the joining station.

Fluxless brazing of aluminum lap joints in air has been accomplished, but substantial development would be required to obtain a heating rate and temperature control consistent with making four joints per minute to the bi-fold terminals.

Thus, in general, brazing or soldering of aluminum requires the use of a flux. Since the residues of the fluxes used in aluminum brazing or soldering are corrosive and electrically conductive in the presence of even slight amounts of moisture, maximum reliability will be achieved only if these fluxes are completely removed. In the transformer application, removal is not technically feasible at an acceptable cost.

Fluxless soldering of aluminum is possible using ultrasonic energy to assist wetting. This technique, however, is best applied to dip soldering operations where the joint area can be immersed in the molten solder bath. In the transformer application, it would not be practical to immerse the bi-fold terminal-to-soft conductor lead joint.

Ultrasonic welding was tried for this application. The results were not acceptable, as the ultrasonically welded joint was not highly reproducible, nor was the weld visually inspectable.

Thus, after studying the various methods for joining aluminum, welding appeared to have the best chance of being successful in the transformer application. Of the various welding techniques available, MIG arc spot welding appeared to offer the best potential for achieving the desired results consistent with the hereinbefore mentioned requirements. Once MIG welding was selected, some additional requirements were imposed in order to assure repeatable joints with on-line inspectability. The welds must be full penetration welds with a well-developed, completely filled button on each end of the weld. The buttons must have a diameter of about 0.5 to 0.625 inch (12.7 to 15.9 mm), and a crown of about 0.040 to 0.0625 inch (1 to 1.6 mm), with the crown extending past the adjacent major surface of the conductor. The weld diameter (throat) must be at least 0.375 inch (9.5 mm) at the interface between the two conductors being joined. Out-of-position welds, i.e., other than downhand, must be accomplished without sag or run of the molten weld material when welding the thicknesses of the usual conductors associated with a distribution transformer application, such as at least 0.100 inch (2.54 mm) and as thick as 0.156 inch (3.96 mm).

Conventional plug welding techniques wherein a pilot hole is provided in one of the two members to be joined, did not produce the desired results. With short welding times, the major problem was inability to achieve full fill. Longer welding times with lower current resulted in a lack of sufficient penetration, or lack of fusion to the side wall of the pilot hole. Raising the voltage and current made it impossible to achieve out-of-position welds, as the molten weld metal sagged, or ran out of the weld puddle. Raising the voltage alone provided an exaggerated funnel-shaped weld cross section. To achieve the desired weld buttons at each end of the weld, and the desired 0.375 inch (9.5 mm) thickness at the interface or throat, required a weld nugget having a cross-sectional configuration which was substantially cylindrical, and thus the exaggerated funnel-shape was completely unsatisfactory. A balance between welding time and welding current could not be achieved which would give full fill and full penetration. A welding procedure was essential which would give the desired results without critical parameters.

Figure 2:
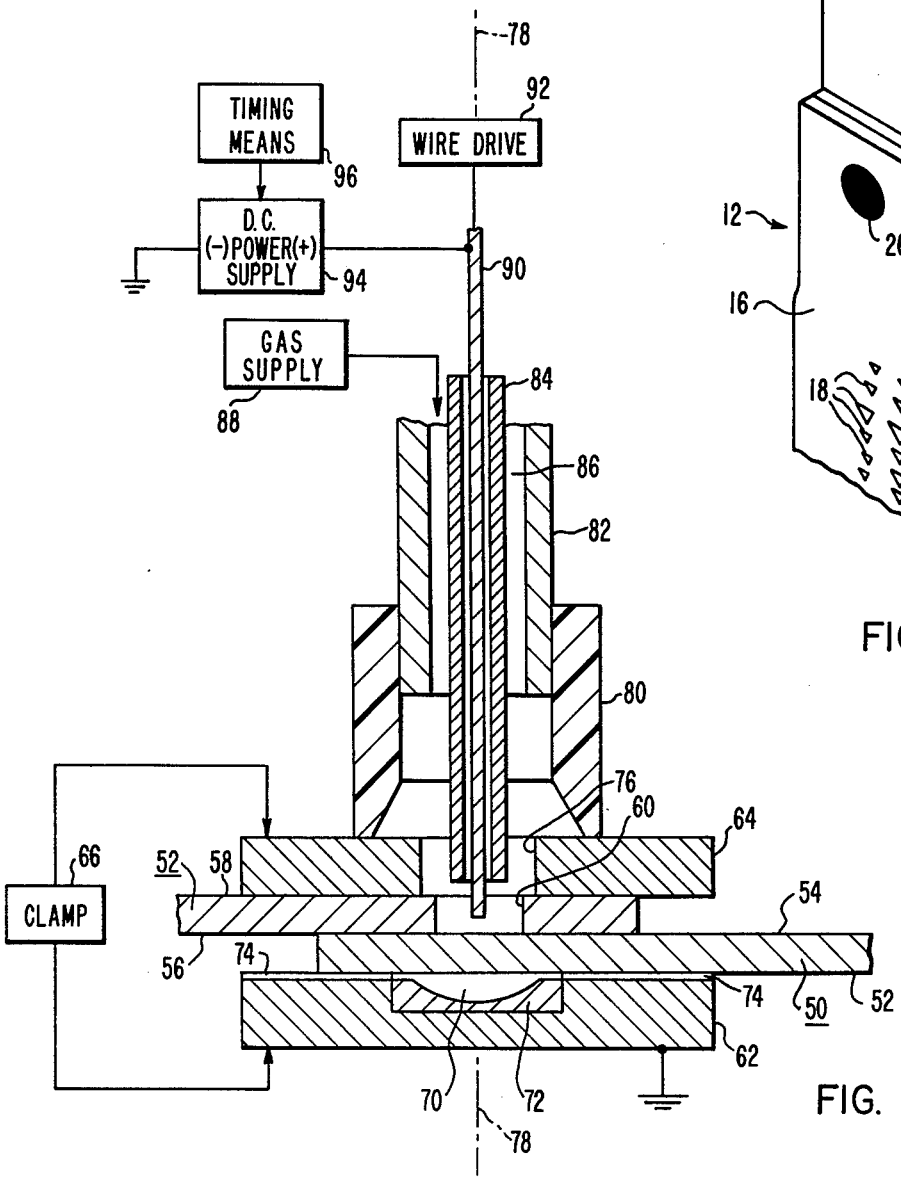
FIG. 2 is a cross-sectional view of MIG arc welding apparatus set up to form an initial step in a new and improved method of joining aluminum conductors, according to the teachings of the invention.

Reproducible, visually inspectable electrical conductor connections having well-developed buttons at the ends of the weld nugget, a 0.375 inch (9.5 mm) weld dimension at the throat or interface, with full fill and no sag or run out, even when the conductors being joined are vertically oriented, was achieved with a multiple timed sequence MIG arc welding process. In other words, the total welding time required to deposit sufficient metal to completely fill the desired weld area is obtained in multiple, short, timed welding increments, with timed delay periods between the welding increments, to allow solidification and some cooling of the deposited weld metal. FIG. 2 is a cross-sectional view of MIG arc welding apparatus used to perform a new and improved method of forming electrical conductor connections according to the teachings of the invention.

More specifically, first and second aluminum conductor members 50 and 52 to be joined are provided, with the first aluminum conductor member 50 having first and second flat, major opposed surfaces 52 and 54 respectively, and with the second aluminum conductor member 52 having first and second flat, major opposed surfaces 56 and 58, respectively. The first and second conductors 50 and 52 may correspond to conductors 16 and 24, or to conductors 24 and 28, shown in FIG. 1.

The second conductor member 52 has a pilot hole 60 formed therein, with a 0.375 inch (9.5 mm) diameter producing excellent results, but other dimensions slightly smaller or slightly larger may be used with success.

The first and second conductor members 50 and 52 are lapped, with the second major surface 54 of the first conductor 50 in contact with the first major surface 56 of the second conductor member 52. The pilot hole 60 is positioned such that it is in the lapped portion.

The lapped conductors 50 and 52 are tightly clamped between first and second metallic clamp members 62 and 64, respectively, with a clamping means, such as a penumatically operated clamp arrangement, being illustrated generally at 66. The first clamp member 62 functions as a backup, and includes a recess 70 in its surface, which faces the first major surface 52 of the first conductor 50. As illustrated, recess 70 may be formed in a replaceable copper insert 72. Recess 70 forms the required weld button at the root end of the weld, for easy visual inspection of joint integrity. Recess 70 is sized to provide the desired "button" size. For example, recess may have a diameter of about 0.5 inch (12.7 mm), and a depth of about 0.040 to 0.080 inch (1 to 2 mm). Good fill of this lower button was consistently achieved after the recess was vented by machining a plurality of grooves 74, which grooves start at the recess and radiate therefrom similar to the spokes of a wheel.

The upper clamp member 64 has an aperture 76 therein which is aligned with the centerline of the pilot hole 60. The centerlines of the aperture 76, pilot hole 60 and recess 70 are all aligned on a common axis or center line 78.

A tubular arc spot nozzle extension 80 is disposed with one of its open ends surrounding the aperture 76, and its other end is sized to snugly receive a tubular MIG gun nozzle 82. A tubular contact tube 84, formed of copper or other suitable conductor material, is disposed with its longitudinal axis on center line 78, with the outside diameter of tube 84 being selected relative to the inside diameter of tube 82 to provide a space 86 for flow of an inert shielding gas from a gas supply shown generally at 88. The inert shielding gas, for example, may be helium, argon, or mixtures thereof.

A consummable electrode or welding wire 90 for the MIG welding process is directed through the opening in the contact tube 84 via a wire drive shown generally at 92. The wire 90 is aluminum welding wire which, as an example, may be EC 1100 or 4043 aluminum having an O.D. of 0.62 inch (1.6 mm), or other suitable diameter. A direct current power supply or welder 94 has its positive terminal connected to the wire 90, and its negative terminal is connected to ground, to provide the reverse polarity configuration of MIG arc sport welding. The backup or bottom clamp member 62 is also connected to ground, to complete the electrical circuit. Suitable timing means, shown generally at 96, controls the length of the various weld-times, as well as the delay time between welds. The conductors 50 and 52 are tightly clamped in position, and the flow of the inert shielding gas is then initiated. The flow rate of the shielding gas is in the range of about 10 to 30 CFH. The wire 90 is inched forward until an arc strikes. A current sensor starts a timer when the arc is initiated, which times the duration of the first weld. An open circuit voltage of 32 volts d.c. and an arc voltage of 28 or 29 volts d.c. has been found to be suitable. The welding current is in the range of 250 to 425 amperes, with a current averaging 320±20 amperes providing good results on the conductor sizes of the examples. A first weld time of 0.4 second has been found to be suitable when using three separate depositions of metal. A three-step deposition of weld metal will be described, as it was found to be very successful with the dimensions of the conductors hereinbefore specified, when making out-of-position welds. However, two steps, or more than three steps, may be utilized using different parameters. At the end of 0.4 second, the arc is extinguished and it is reinitiated after a delay of about 2.5 seconds. It is important to maintain the flow of the inert shielding gas at all times, even during the delay periods.

Figure 3:
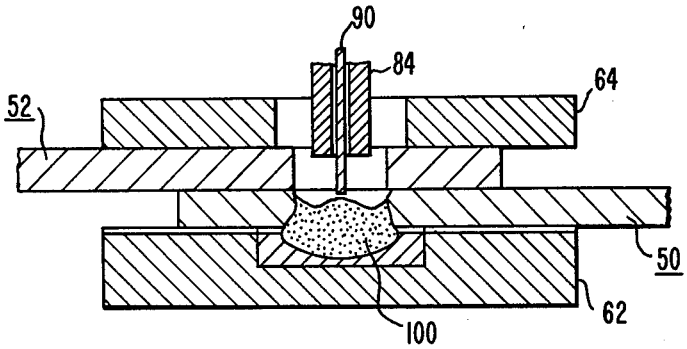
FIGS. 3, 4 and 5 are cross-sectional views of the MIG arc welding apparatus shown in FIG. 1, illustrating additional steps in the method of joining aluminum conductors to provide an electrical conductor connection according to the teachings of the invention.
Figure 4:
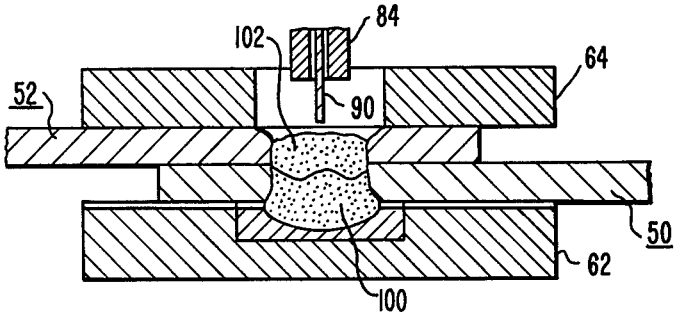
Figure 5:
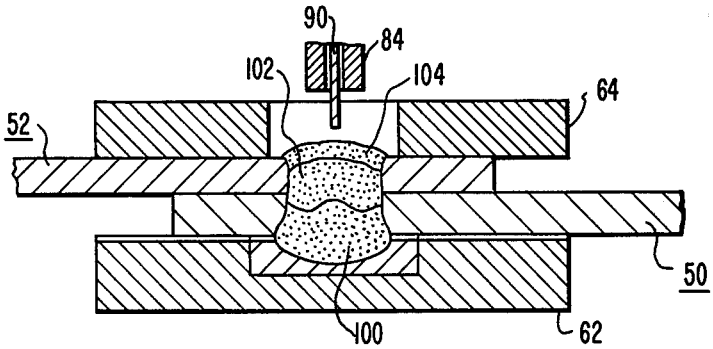
Figure 6:
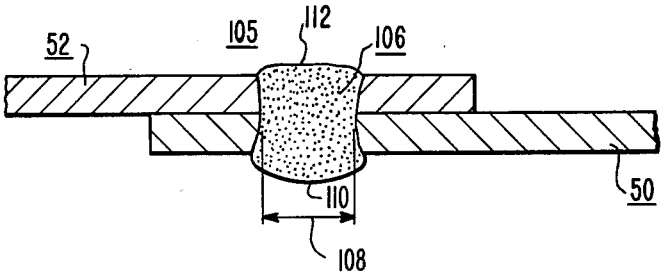
FIG. 6 is a cross-sectional view of an electrical conductor connection which includes a weld nugget having a substantially cylindrical cross-sectional configuration, and convexly cupped ends, according to the teachings of the invention.

As illustrated in FIG. 3, the first welding step melts the metal of the first conductor 50 and it, along with metal which has melted from the electrode or wire 90, runs into the recess 70 forming a weld pool 100 of molten aluminum. The groove 74 allows gas to escape from the recess and enable the recess to consistently fill with aluminum without trapping air which forms voids or bubbles. After about 2.5 seconds, which enables the weld pool 100 to partially solidify, the arc is reinitiated for about 0.2 second. The second welding step melts the sides of the pilot hole 60 and it, along with metal from the consummable electrode 90, forms a weld puddle 102 which adds to the fusion of aluminum 100 already created in the first step. The adding of weld material 100 is shown in FIG. 4. After a delay of about 2.5 seconds, during which the weld pool 102 at least partially solidifies, the welding arc is re-established for 0.2 second, which adds additional aluminum 104 from the wire 90 to the fusion of aluminum weld material. The third step, shown in FIG. 5, completes the filling of the pilot hole 60 and adds additional aluminum to the point of creating a convexly shaped weld button at the top of the weld having a diameter of about 0.625 inch (1.5 mm) and a crown or height above the second major surface 58 of conductor 52 of about 0.0625 inch (1.6 mm). A typical weld nugget 106 consumes about $7\frac{1}{4}$ inches $\pm\frac{1}{4}$ inch (194±6.4 mm) of 0.062 inch (1.6 mm) aluminum welding wire. After a delay of about 2 seconds, the parts are unclamped to provide the electrical conductor connection 105 having a weld nugget 106 which has a substantially cylindrical cross-sectional configuration, as shown in FIG. 6. The diameter or throat, indicated at 108, of the weld nugget 106 is 0.375 inch (9.5 mm) minimum. The buttons 110 and 112 at the root and top of the weld nugget 106, respectively, provide easy on-line inspectability. If the weld buttons are fully formed without voids, the electrical conductor connection is good both electrically and mechanically.

The multiple timed, sequenced MIG arc welding described herein may be successfully applied to out-of-position welds, i.e., the conductors 50 and 52 may be vertically oriented. The multiple deposition of welding material with delays for cooling the weld puddle provides the desired weld nugget without sag or run of the weld pool. The Figures may be re-oriented to illustrate out-of-position welding according to the teachings of the invention.

In summary, there has been disclosed a new and improved electrical conductor connection, and method of making same, between at least two relatively thick aluminum conductor members. Timed, sequenced, arc welding deposits the weld material in two or more steps to form the desired weld nugget configuration, wherein the fusion of metal, in cross section, has the substantially cylindrical configuration necessary to provide the desired throat dimension, and the desired convexly shaped weld buttons, all of which are essential to obtaining a good electrical and mechanical joint, as well as the essential on-line inspectability. The disclosed welding process is fast, permitting four joints to be performed in one minute, it is easily adapted to automation techniques, it may be applied to out-of-position welds without sag or run of the weld pool, and it may be performed with production line personnel who have no specific welding skills. The sequenced welds may be performed automatically after an operator positions the two conductors and initiates the clamping thereof.

We claim as our invention:

1. An electrical conductor connection, comprising:

first and second aluminum conductor members each having first and second major opposed flat surfaces, and each having a thickness dimension of at least 0.100 inch, said first and second metallic conductor members being lapped with at least a portion of their second and first major flat surfaces, respectively, in contact with one another, and a fusion of aluminum joining said lapped first and second aluminum conductor members, said fusion of aluminum having a central portion fused to both said first and second metallic conductor members, and first and second end portions, with the diameter of the fusion of aluminum at the interface between the first and second aluminum conductor members being at least 0.375 inch, said first and second end portions being convexly cupped and extending outwardly past the first and second major flat surfaces of said first and second metallic conductor members, respectively, said at least 0.375 inch diameter of the connecting central portion of the fusion of aluminum at said interface being the minimum diameter of the fusion of aluminum measured at any point between the first and second major flat surfaces of the first and second metallic conductor members, in a direction parallel with their major flat surfaces.

2. The electrical conductor connection of claim 1 wherein the first conductor member is an aluminum bi-fold crimp terminal of predetermined hardness, and the second conductor is formed of aluminum which is softer than the first conductor, to provide a flexible lead, and including a third conductor member formed of aluminum which is harder than the second conductor, said third conductor member being lapped with the second conductor member, and a second fusion of aluminum joining the lapped second and third conductor members, said second fusion of aluminum being similar in configuration to the fusion of aluminum joining the lapped first and second conductor members.

* * * * *